US012295452B2

(12) United States Patent
Schwartz

(10) Patent No.: US 12,295,452 B2
(45) Date of Patent: May 13, 2025

(54) PRESSURE RELIEF INSOLE FOR SHOES

(71) Applicant: SBT, Inc., Skokie, IL (US)

(72) Inventor: Yitzchok Moshe Schwartz, Chicago, IL (US)

(73) Assignee: SBT, Inc., Skokie, IL (US)

( * ) Notice: Subject to any disclaimer, the term of this patent is extended or adjusted under 35 U.S.C. 154(b) by 257 days.

(21) Appl. No.: 17/658,661

(22) Filed: Apr. 11, 2022

(65) Prior Publication Data

US 2023/0255312 A1 Aug. 17, 2023

Related U.S. Application Data

(63) Continuation-in-part of application No. 29/791,911, filed on Feb. 17, 2022, and a continuation-in-part of application No. 29/791,909, filed on Feb. 17, 2022.

(51) Int. Cl.
*A43B 13/20* (2006.01)
*A43B 17/14* (2006.01)

(52) U.S. Cl.
CPC ..... *A43B 13/20* (2013.01); *A43B 17/14* (2013.01)

(58) Field of Classification Search
CPC ..... A43B 7/144; A43B 7/1445; A43B 7/148; A43B 13/40; A43B 17/006; A43B 17/142
See application file for complete search history.

(56) References Cited

U.S. PATENT DOCUMENTS 1,822,981 A * 9/1931 Prouty ..... A43B 7/14 36/22 A
4,387,516 A * 6/1983 Laux ..... A43B 3/0078 36/43
4,510,700 A 4/1985 Brown
(Continued)

FOREIGN PATENT DOCUMENTS

AU 2014286929 B2 1/2015
CA 2523884 C 11/2004
(Continued)

OTHER PUBLICATIONS

Dr. Scholl's 24-Hour Energy Insoles, Amazon.com, [online], [site visited Sep. 12, 2024], <URL://www.amazon.com/Dr-Scholls-24-Hour-Insoles-Massaging/dp/BOD411N5ZR> (Year: 2024).
(Continued)

*Primary Examiner* — Sharon M Prange
*Assistant Examiner* — Grady Alexander Nunnery
(74) *Attorney, Agent, or Firm* — Brian Roffe

(57) ABSTRACT

Insole includes a base having a shape for placement onto a sole of or in a shoe, and which base has at least one cavity extending inward from a lower surface over only a part thereof, and surrounded peripherally by the base, such that over a remaining part, the lower surface is a lowermost surface of the insole. A mesh is attached to an upper surface of the base and forms an uppermost surface of the insole. An air cushion is present in each cavity, and includes a sealing structure and lightweight foam pieces held in each cavity by the sealing structure such that when in the respective cavity, each air cushion is a lowermost surface of the insole. The sealing structure may be a plastic membrane attached to the base around a periphery of the respective cavity or a plastic membrane that surrounds the foam pieces.

20 Claims, 14 Drawing Sheets

(56) References Cited

U.S. PATENT DOCUMENTS

| | | | | |
|---|---|---|---|---|
| 4,686,993 | A | 8/1987 | Grumbine | |
| 5,146,698 | A | 9/1992 | Tilles et al. | |
| 5,517,770 | A | 5/1996 | Martin | |
| D376,898 | S | 12/1996 | Passke | |
| 5,694,705 | A | 12/1997 | Alonso Coves | |
| D397,236 | S | 8/1998 | Wilmot | |
| 6,023,857 | A | 2/2000 | Vizy et al. | |
| 6,233,847 | B1 | 5/2001 | Brown | |
| 6,301,805 | B1 | 10/2001 | Howlett | |
| D460,852 | S | 7/2002 | Daudier | |
| 6,684,532 | B2 | 2/2004 | Greene et al. | |
| D496,781 | S | 10/2004 | Hikade | |
| 7,082,704 | B2 | 8/2006 | Throneburg et al. | |
| 7,266,908 | B2 | 9/2007 | Issler | |
| D664,754 | S | 8/2012 | Klein | |
| 8,453,346 | B2 | 6/2013 | Steszyn et al. | |
| 8,479,413 | B2 * | 7/2013 | Avent | A43B 13/12 36/108 |
| D698,137 | S | 1/2014 | Carr | |
| 8,671,590 | B2 | 3/2014 | Rasmussen et al. | |
| 9,021,721 | B2 | 5/2015 | McCarron | |
| 9,107,472 | B2 | 5/2015 | Donzis et al. | |
| 9,572,394 | B2 | 2/2017 | Heard et al. | |
| 9,635,904 | B2 | 5/2017 | Wakeland et al. | |
| 9,750,302 | B2 | 9/2017 | Hanft | |
| 9,943,132 | B1 | 4/2018 | Tsai | |
| D860,616 | S | 9/2019 | Cran | |
| D869,833 | S | 12/2019 | Hartmann | |
| D871,731 | S | 1/2020 | Behr | |
| D872,436 | S | 1/2020 | Matthews | |
| D872,437 | S | 1/2020 | Matthews | |
| D872,438 | S | 1/2020 | Matthews | |
| D876,063 | S | 2/2020 | Matthews | |
| D876,776 | S | 3/2020 | Matthews | |
| D878,015 | S | 3/2020 | Hartmann | |
| D879,430 | S | 3/2020 | Gerig | |
| D880,822 | S | 4/2020 | Hartmann | |
| D880,825 | S | 4/2020 | Garcia | |
| D884,330 | S | 5/2020 | Chen | |
| D886,429 | S | 6/2020 | Ayres | |
| D893,843 | S | 8/2020 | Hartmann | |
| D903,268 | S | 12/2020 | Wu et al. | |
| D906,658 | S | 1/2021 | Wu et al. | |
| D919,275 | S | 5/2021 | Little | |
| 11,064,766 | B2 | 7/2021 | Kfir | |
| D932,170 | S | 10/2021 | Buck | |
| D935,758 | S | 11/2021 | Wu et al. | |
| D977,793 | S | 2/2023 | Mao | |
| D977,798 | S | 2/2023 | Zheng | |
| 11,678,714 | B2 | 6/2023 | Huang | |
| D996,793 | S | 8/2023 | Baig | |
| 11,744,321 | B2 | 9/2023 | Hurd | |
| 11,882,898 | B2 | 1/2024 | Mason | |
| 1,028,465 | A1 | 5/2024 | Qin | |
| 2008/0005936 | A1 | 1/2008 | Chiu | |
| 2009/0193683 | A1 | 8/2009 | Igdari | |
| 2011/0252665 | A1 | 10/2011 | Tsai | |
| 2012/0137540 | A1 | 6/2012 | Vattes et al. | |
| 2013/0081306 | A1 | 4/2013 | Park et al. | |
| 2016/0037859 | A1 | 2/2016 | Smith | |
| 2018/0078000 | A1 * | 3/2018 | Legein | A43D 95/06 |
| 2018/0140040 | A1 | 5/2018 | Granger | |
| 2019/0090583 | A1 * | 3/2019 | Sato | A43B 7/1475 |
| 2019/0351592 | A1 * | 11/2019 | Falken | B29C 44/422 |
| 2020/0375307 | A1 * | 12/2020 | Hurd | A43B 13/125 |
| 2021/0085020 | A1 | 3/2021 | Grever et al. | |
| 2021/0186143 | A1 | 6/2021 | Beck et al. | |
| 2021/0235814 | A1 | 8/2021 | Ye et al. | |
| 2021/0244129 | A1 * | 8/2021 | Boehler | A43B 13/122 |
| 2021/0361027 | A1 | 11/2021 | Duflinger et al. | |
| 2024/0237779 | A1 | 7/2024 | Yao | |

FOREIGN PATENT DOCUMENTS

| | | | |
|---|---|---|---|
| CA | 2713114 | C | 7/2009 |
| CN | 308272414 | | 10/2023 |
| WO | 2021124068 | A | 6/2021 |

OTHER PUBLICATIONS

Insole Buddy Targeted Pain Relief Air Encapsulate Micro Bead technology Insole, website archived Mar. 4, 2023, [online], [site visited Sep. 12, 2024],, <URL: https://web.archive.org/web/20230304135623/https://insolebuddy.com/products/copy-of-plantar-fascitis-microbead-technology> (year: 2023).

* cited by examiner

PRESSURE RELIEF INSOLE FOR SHOES

FIELD OF THE INVENTION

The present invention relates to insoles for shoes that can be placed onto or inserted into shoes to improve comfort of the wearer and/or provide support to the wearer. The present invention also relates to insoles that can be incorporated into shoes, and method for manufacturing such insoles.

BACKGROUND OF THE INVENTION

Various types of cushioning insoles are well known for use in footwear, particularly running shoes and other shoes used for athletic activities. Typically, these insoles take the form of a relatively thin layer of foam material that is placed over the midsole of the shoe and can often be removed for cleaning or replacement.

Conventional insoles of this general type generally have non-optimal support or cushioning characteristics in use. Efforts are often made to impart a significant contour to the top surface of the foam material to support and provide a cradle for the wearer's foot, but since foam is primarily used to provide cushioning for the foot, it often lacks sufficient strength and hardness to provide the necessary support for the proper biomechanical function of the foot, particularly in the hindfoot and arch regions.

U.S. Pat. No. 9,635,904 (Wakeland et al.) assert that this problem may be exacerbated by the fact that: most athletic shoes are "soft-sided" to a greater or lesser extent, i.e., the upper is formed of cloth, vinyl, or other flexible material that yields outward under pressure, providing very little inwardly-buttressing support around the insole. As a result, conventional contoured insoles tend to deform and "collapse" downwardly and outwardly under the foot without providing any meaningful degree of support, and also tend to crack and lose their shape over time. Accordingly, Wakeland et al. identify a need for a lightweight, low cost contoured insole that provides effective cushioning to the foot, yet is durable and long lasting in use.

Their patent describes an insole that includes a cushioning member and a support member. The cushioning member has an upper surface for engaging a plantar surface of a foot and a bottom surface for engaging a sole of the footwear and the support member. The support member engages with a portion of the bottom surface of the cushioning member. The support member has a rearfoot portion which extends around a heel end of the cushioning member, medial and lateral side portions which extend forwardly from the rearfoot portion on opposite sides of a central opening in the support member, and a front-end portion connecting the medial and lateral side portions near a midfoot region of the footwear enclosing the central opening in the support member along a perimeter of the cushioning member.

OBJECTS AND SUMMARY OF THE INVENTION

It is an object of at least one embodiment of the present invention to provide a new and improved insole and method for manufacturing insoles.

It is another object of at least one embodiment of the present invention to provide a new and improved pressure relief insole and method for manufacturing such insoles.

It is an object of at least one embodiment of the present invention to provide a new and improved insole that is particularly beneficial to people who work on their feet, i.e., standing up, and method for manufacturing such insoles.

It is another object of at least one embodiment of the present invention to provide an insole that can be inserted into the shoes to improve comfort of the wearer and/or provide support to the wearer and method for manufacturing such insoles.

It is still another object of at least one embodiment of the present invention to provide an insole that can be incorporated into shoes and method for manufacturing such insoles. It is yet another object of at least one embodiment of the present invention to provide shoes that incorporate a new and improved insole.

In order to achieve one or more of these objects, an insole in accordance with the invention includes a base having a shape for placement onto a sole of a shoe, and which base has a lower surface, an upper surface, and at least one cavity extending inward from the lower surface over only a part of the lower surface such that over a remaining part of the lower surface, the lower surface is a lowermost surface of the insole. Each cavity may be defined in part by a downward-facing surface recessed inward of the lower surface of the base. The insole also includes a mesh attached to the upper surface of the base and which forms an uppermost surface of the insole. An air cushion is arranged in each cavity, is preferably peripherally surrounded by the base and includes a sealing structure and lightweight foam pieces held in each cavity by the sealing structure such that when in the respective cavity, each air cushion is a lowermost surface of the insole. The sealing structure may be a plastic membrane attached to the base around a periphery of the respective cavity, so that the sealing structure seals the foam pieces in the cavity from the bottom. Alternatively, the air cushion may include a plastic membrane serving as the sealing structure and which surrounds the foam pieces and is insertable with the foam pieces into the respective cavity. Each cavity may be further defined by a side surface of the base extending around a periphery of the cavity.

In one embodiment, there is a single cavity and associated air cushion. Preferably, the single cavity has an enlarged portion near a front of the base and tapers inward in a direction rearward until a waist or instep of the insole and then increases in width in a direction toward a rear of the insole.

In another embodiment, there are three separate cavities and associated air cushions. One cavity is in a heel area of the insole and has an oblong shape, a second cavity is forward of the first separate cavity and has an oblong shape with a flared area that tapers outward toward a front of the insole, and a third cavity is in an area configured to accommodate a sole or ball of the wearer's foot.

A method for manufacturing an insole in accordance with the invention includes providing a base having a shape for insertion onto a sole of a shoe, the base having the characteristics described above, attaching a mesh to the upper surface of the base, and arranging a respective air cushion in each cavity to be peripherally surrounded by the base, each air cushion being as described above.

The mesh may be attached to the upper surface of the base by gluing the mesh and the base together and then heat-pressing the mesh and base against one another. The air cushions may be arranged in the respective cavity by placing foam pieces into the respective cavity and then attaching a membrane to the base around the respective cavity to form a sealing structure that seals the foam pieces in the cavity, or by forming the respective air cushion with the foam pieces enclosed within a membrane to form a sealing structure and then inserting this foam piece-containing sealing or enclosing structure into the cavity.

BRIEF DESCRIPTION OF THE DRAWINGS

The following drawings are illustrative of embodiments of the system developed or adapted using the teachings of at least one of the inventions disclosed herein and are not meant to limit the scope of the invention as encompassed by the claims.

DETAILED DESCRIPTION OF THE INVENTION

Figure 1:
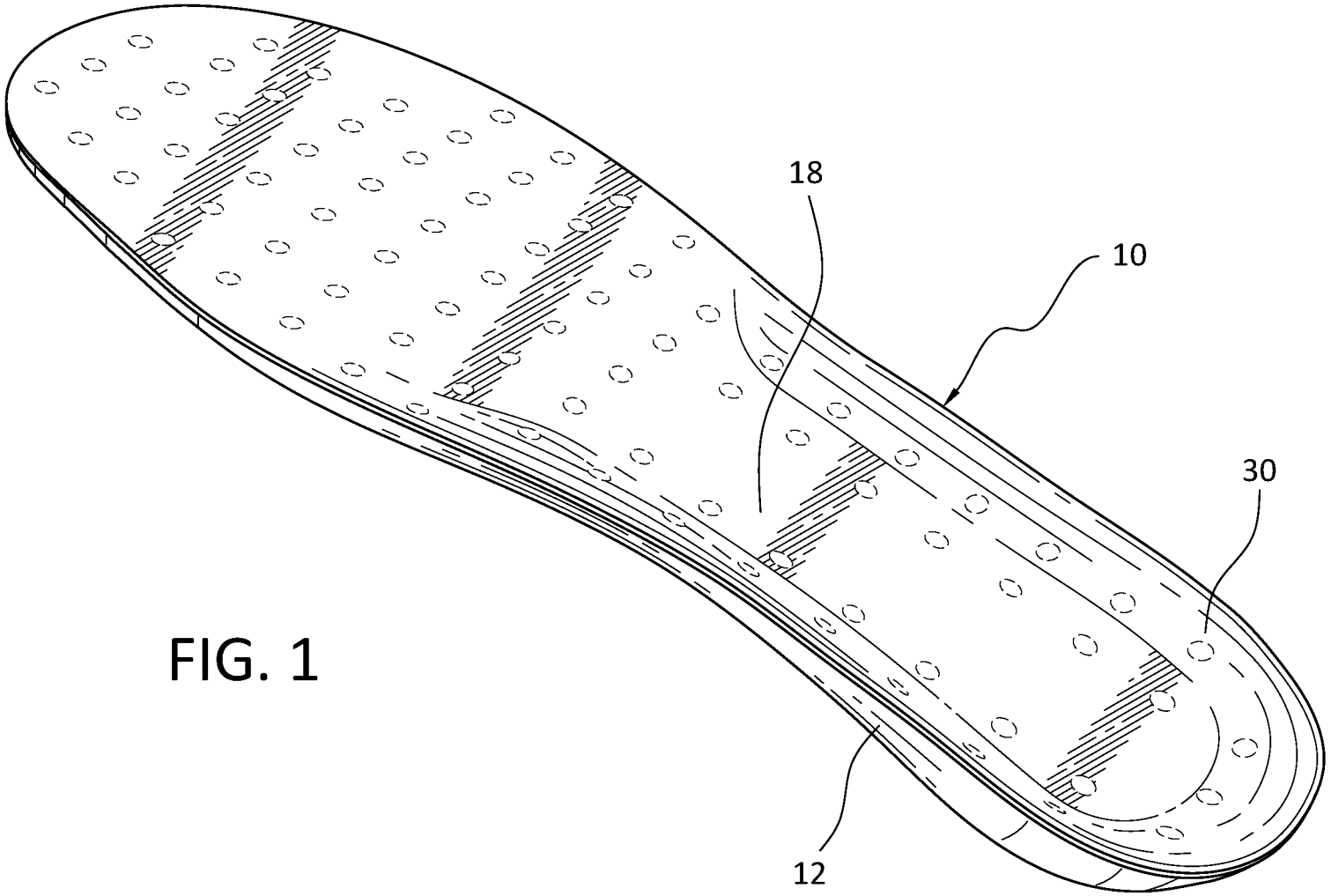
FIG. 1 is a perspective view of a first embodiment of an insole in accordance with the invention.

Referring to the accompanying drawings wherein like reference numbers refer to the same or similar elements, FIG. 1 shows a perspective view of a first embodiment of an insole 10 in accordance with the invention. Insole 10 may be integrated into a shoe, including sneakers, work shoes and other types of shoes without limitation, or be what is often referred to as an aftermarket insole which is purchased separately and inserted into an existing shoe of any type. Both the insoles disclosed herein and shoes incorporating such insoles are considered as the invention.

Generally, an insole is designed to provide comfort and/or support to the user.

Insoles for footwear are often contoured having a soft cushioning upper member and a rigid reinforcement support that cradles the cushioning member so as to provide support at predetermined areas of the insole and to reduce deformation of the front end of the cushioning member.

Figure 9:
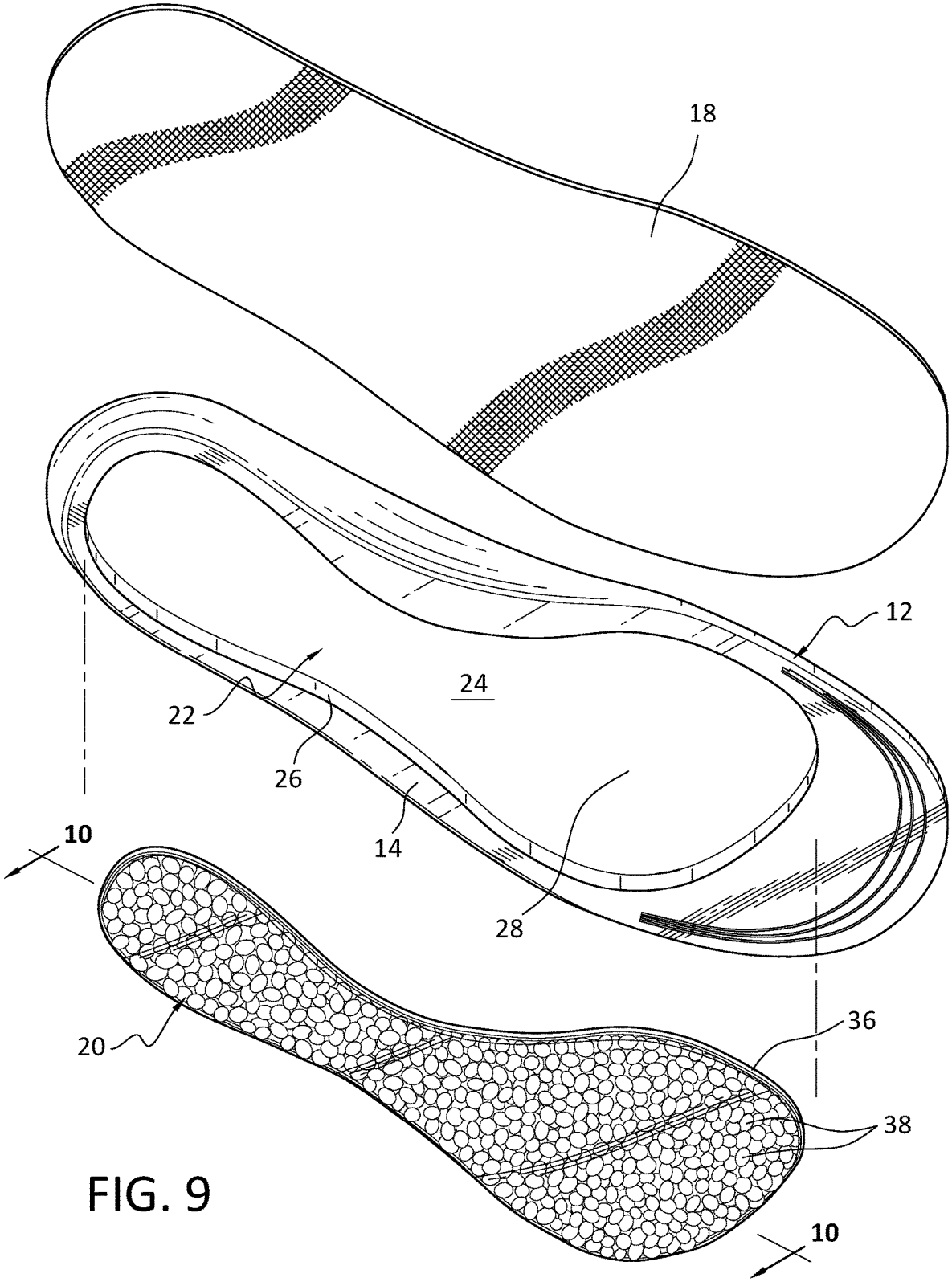
FIG. 9 is an exploded view of the insole shown in FIG. 1.

To achieve this overall objective, the insole 10 in accordance with the invention includes essentially only three components, namely, a plastic base 12 having the shape of an insole configured for placement onto a sole of or in a shoe, and a lower surface 14 and an upper surface 16 on a side of the base 12 opposite the lower surface 14, a mesh 18 attached to the upper surface of the base 12, and an air cushion 20 arranged in a cavity 22 on the lower surface 14 of the base 12 (best seen in FIG. 9). The shape of the insole 10 is a well-known shape that conforms to known shoes or shoe interiors, and to this end, the peripheral shape of the base 12 generally determines the shape of the insole 10, with the peripheral shape of the mesh 18 closely conforming to or being exactly the same as the shape of the base 12. The invention is not limiting to any particular shape of the base 12/mesh 18 or more generally the insole 10.

The lower surface 14 of the base 12 will form the lowermost surface of the insole 10 at locations or areas at which the cavity 22 is not present, while the upper surface of the mesh 18 will form the uppermost surface of the insole 10. Where the cavity 22 is present, the air cushion 20 will provide the lowermost surface of the insole 10. This does not however preclude the presence of additional overlying or underlying layers.

The cavity 22 is formed in the lower surface 14 of the base 12 so that a downward-facing surface 24 of the cavity 22 is inward of the lower surface 14 of the base 12, i.e., recessed inward in a direction toward the upper surface 16 of the base 12 (see FIG. 9). The cavity 22 is also defined by a side surface 26 that extends around the periphery of the cavity 22. The cavity 22 is within the base 12 in the sense that it has a surrounding side surface formed by part of the base 12 and does not extend to of through a side surface of the base 12. Thus, the circumferential edge of the air cushion 20 in its entirety is preferably adjacent to and against the side surface 26 of the cavity 22 over the entire length thereof. This provides a circumferential surrounding of the air cushion 20 or a peripherally surrounding of the air cushion 20 by the base 12, in contrast to a configuration in which the air cushion is along an edge of the insole, i.e., extends inward from an edge of the insole or its base, and is not entirely surrounded by the base 12. By positioning the air cushion 20 within the base to be peripherally surrounded thereby, improvements in the retention of the air cushion 20 by the base 12 and the cushioning effect are obtained since the air cushion 20 is secured within the base 12 and unable to move laterally to a side of the insole 10. As downward pressure is exerted during use, the air cushion 20 is forced to provide a counterforce upward, and cannot expand laterally to relieve this pressure.

In the regions of the insole 10 that do not include the cavity 22, support and/or cushioning is provided by the combination of only the base 12 and the mesh 18 above the base 12 (the foot of the wearer being above the mesh 18). However, when the cavity 22 is present, then the support and/or cushioning is provided by the combination of the mesh 18 and the air cushion 20.

The cavity 22 is shaped to enable the air cushion 20 therein to provide comfort and/or support to the person exerting pressure on the insole 10 via their foot when the insole 10 is used by being inserted into a shoe of the person or placed on a shoe support surface. To this end, the shape of the cavity 22 can vary and its shape designed with a view toward optimizing comfort and/or support for different shaped feet, as would be within the purview of those skilled in the art to which this invention pertains. The invention however provides one particularly beneficial shape for this cavity 22.

Specifically, the cavity 22 has an enlarged portion 28 near the front of the base 12 and tapers inward in a direction rearward until the waist or instep of the insole 10. The cavity 22 then increases in width as it continues toward the rear of the insole 10. The taper and size of the enlarged portion 28 can vary as desired.

Figure 2:
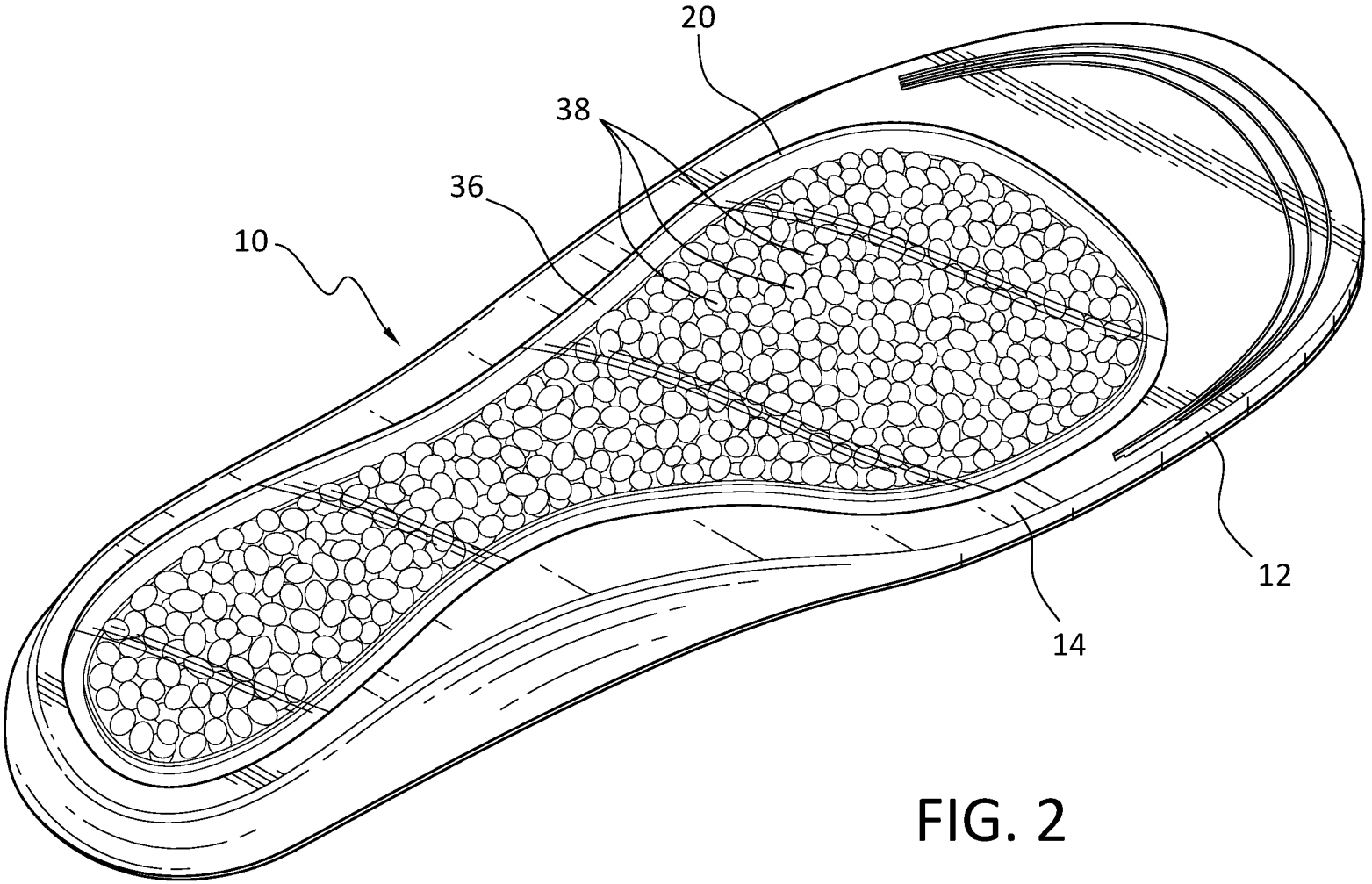
FIG. 2 is a bottom, rear, right side perspective view of the insole shown in FIG. 1.
Figure 3:
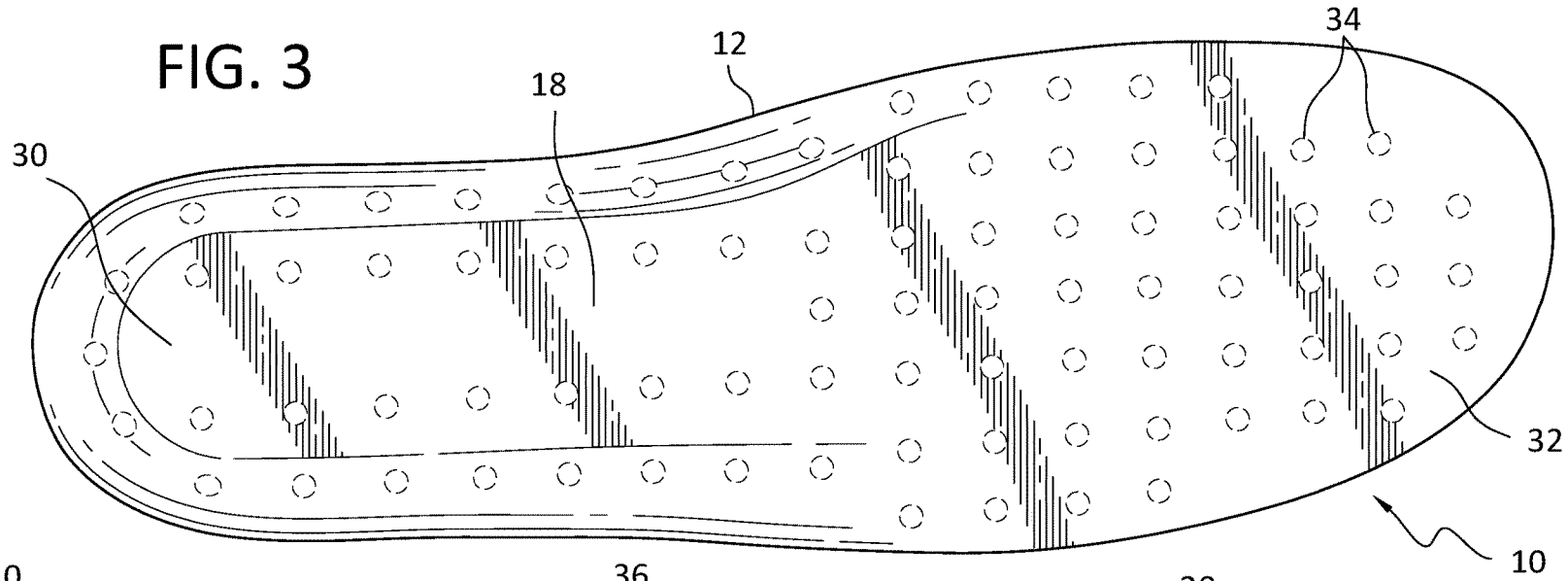
FIG. 3 is a top view of the insole shown in FIG. 1.
Figure 4:
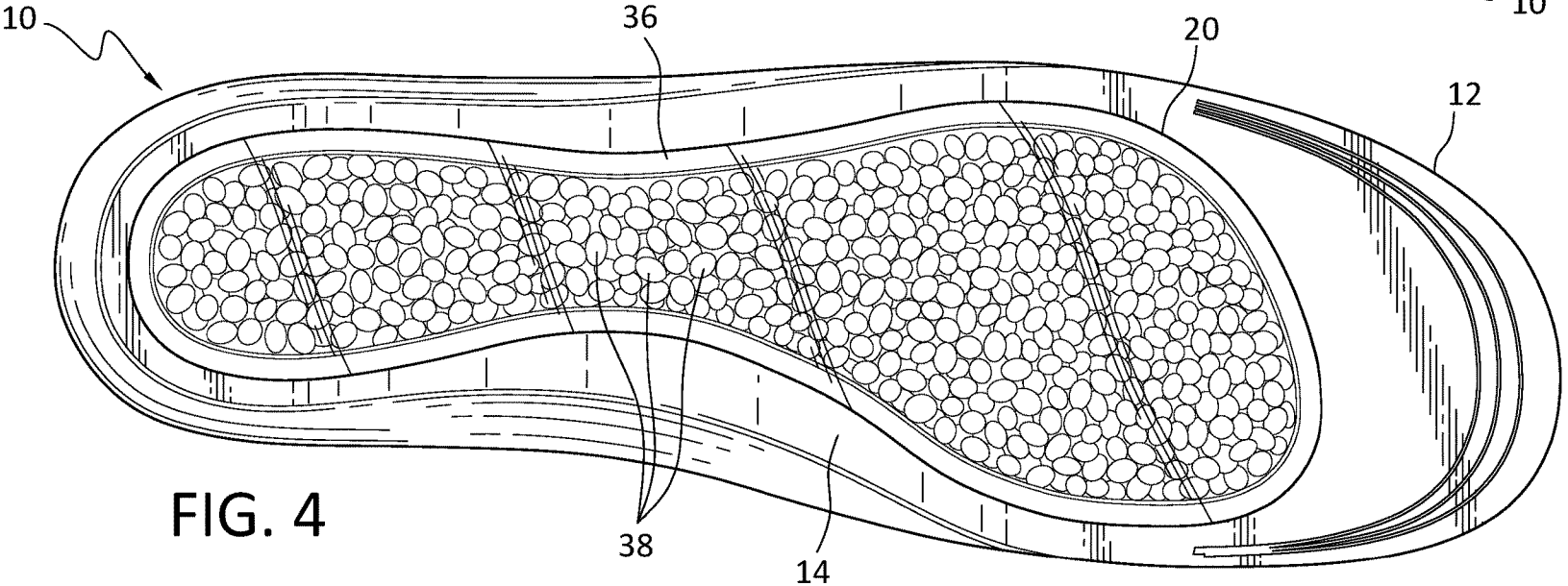
FIG. 4 is a bottom view of the insole shown in FIG. 1.
Figure 5:
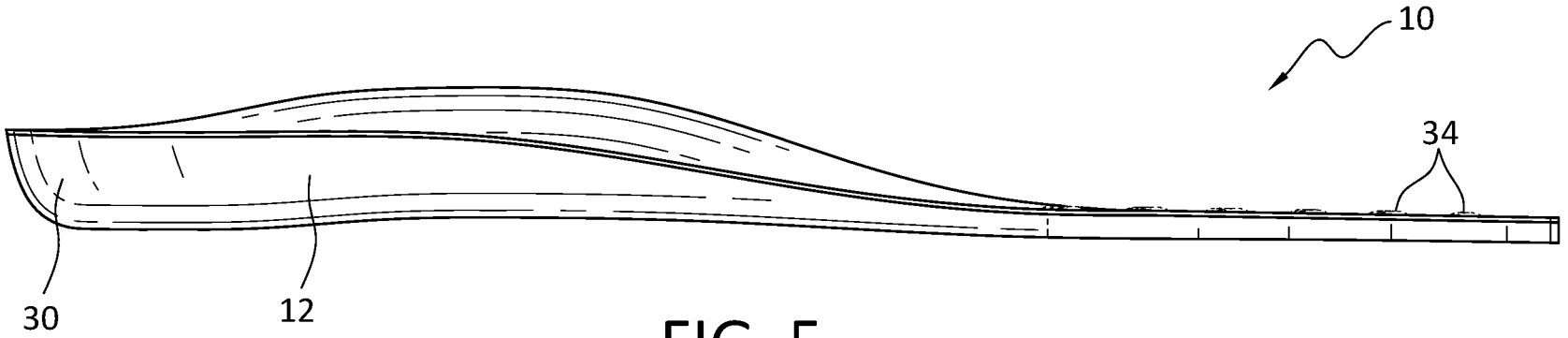
FIG. 5 is a left side view of the insole shown in FIG. 1.
Figure 6:
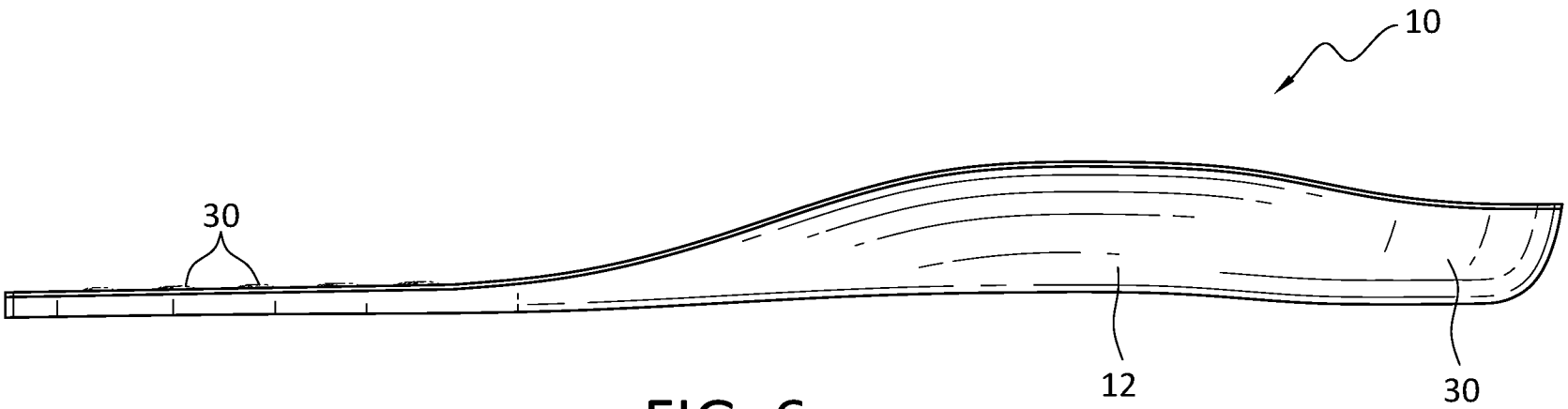
FIG. 6 is a right side view of the insole shown in FIG. 1.
Figure 8:
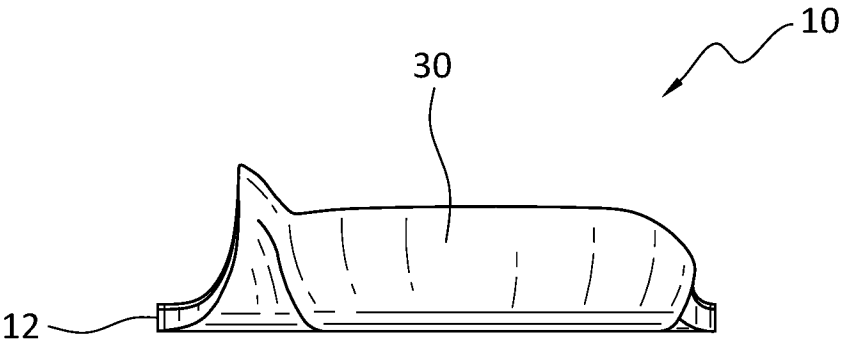
FIG. 8 is a rear view t of the insole shown in FIG. 1.

The base 12 may be made of polyurethane or high elastic ethylene-vinyl acetate (EVA), that is preferably wear-resistant and cushioning. It also could provide shock absorption and pain relief. The polyurethane is durable, soft and capable of shock-absorption. The material, whether polyurethane or otherwise, also preferably has anti-hydrolytic, anti-tear and/or anti-friction properties. The base 12 is designed to enable a wearer to trim the insole 10 to fit their shoe. To this end, there are preferably one or more cut marks on the underside of the base 12, i.e., on the lower surface of the base 12, in the front area near where the toes of the wearer would be situated (see FIGS. 2, 4 and 9). The cut marks have a generally arcuate shape to guide the cutting to contour the front of the insole 10 to the desired length while maintaining the generally arcuate form of the front of the insole 10.

Figure 7:
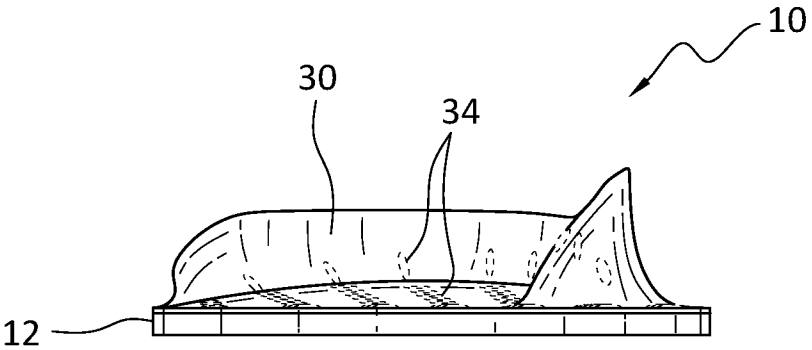
FIG. 7 is a front view of the insole shown in FIG. 1.

A heel part 30 of the base 12 has a general U-shape which is designed to provide pain relief and maintain a stable deep heel (see FIGS. 1 and 7). The U-shape will urge the wearer's foot downward and make the foot feel like it is in a correct position.

The mesh 18 has a lower surface that is attached to the upper surface of the base 12 and an upper surface 32 on which material dots 34 are formed. These material dots 34 may be made of adhesive such as glue that is dried and forms an anti-slip construction that hinders and ideally prevents the person using the insole 10 from slipping, i.e., from their foot moving relative to the insole 10. The mesh 18 may be considered a high-quality mesh in that it is wear-resistant and made of a breathable material. As such, it can dissipate heat generated during use of the footwear. The air permeability of the mesh 18 could also draw sweat produced during use, e.g., during strenuous activity when the insole 10 may be inserted into athletic footwear.

Figure 10:
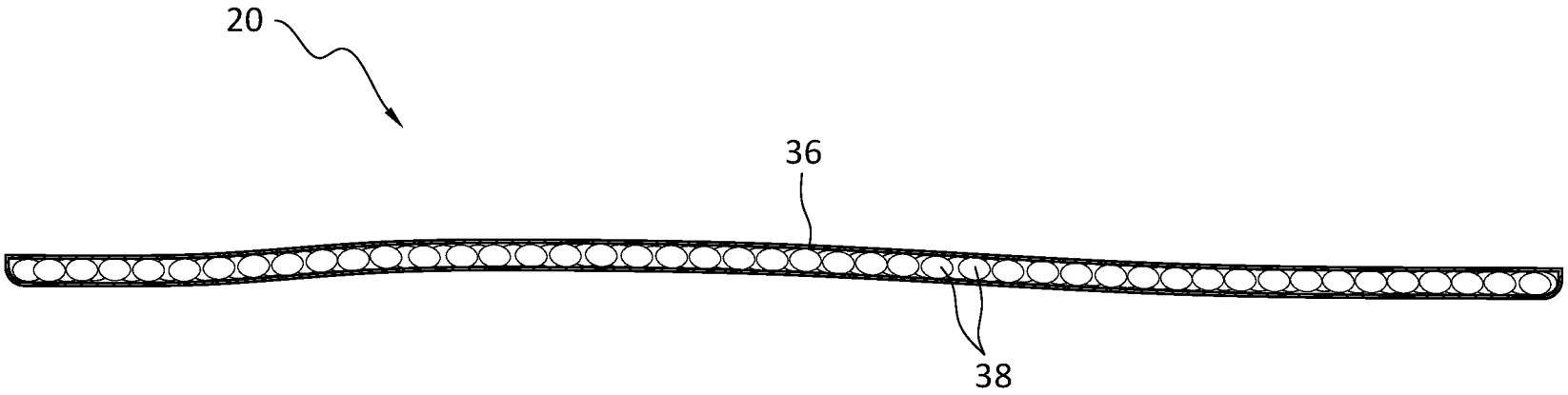
FIG. 10 is a cross-sectional view taken along the line 10-10 in FIG. 9.
Figure 11:
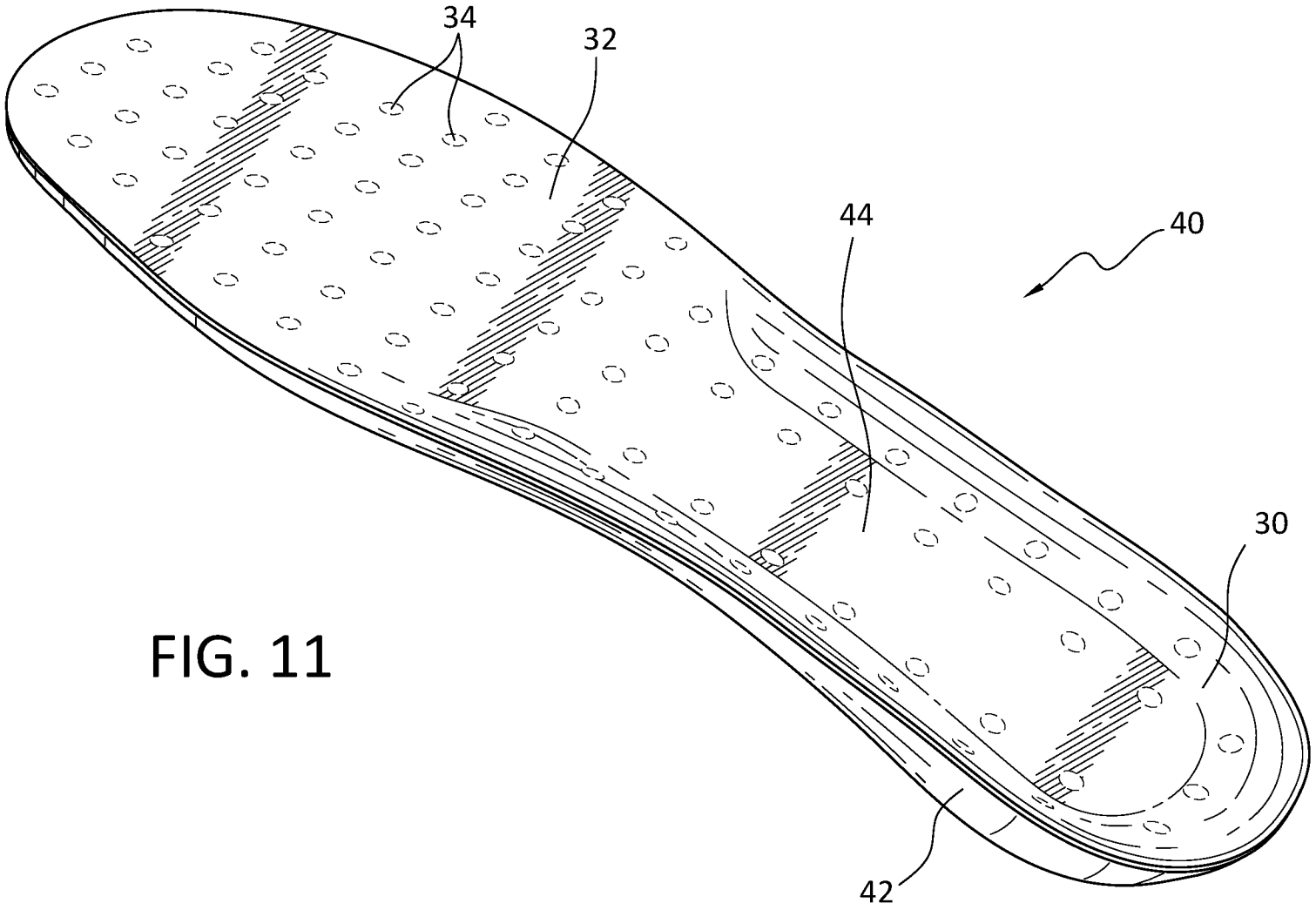
FIG. 11 is a perspective view of a second embodiment of an insole in accordance with the invention.
Figure 12:
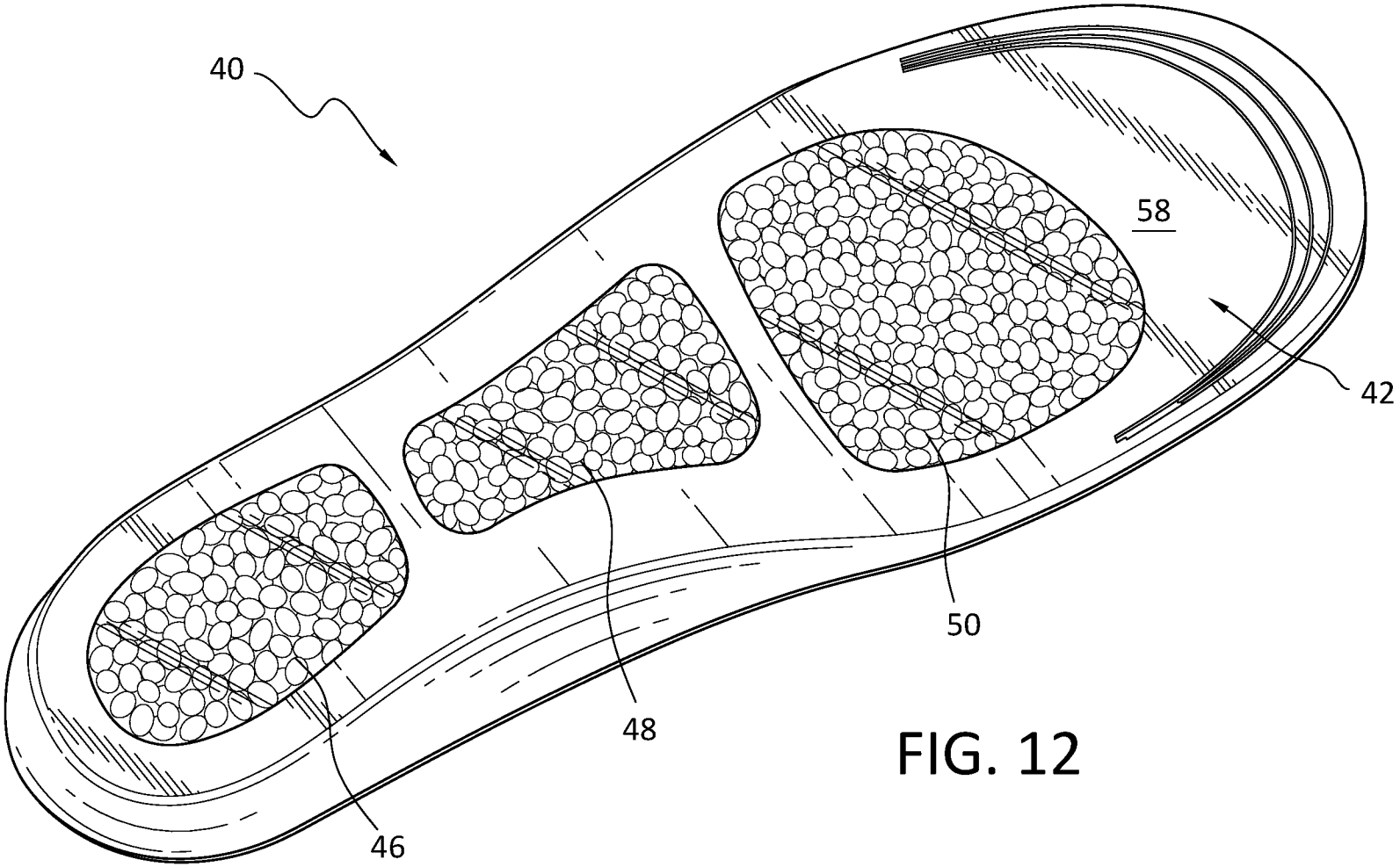
FIG. 12 is a bottom, rear, right side perspective view of the insole shown in FIG. 11.
Figure 13:
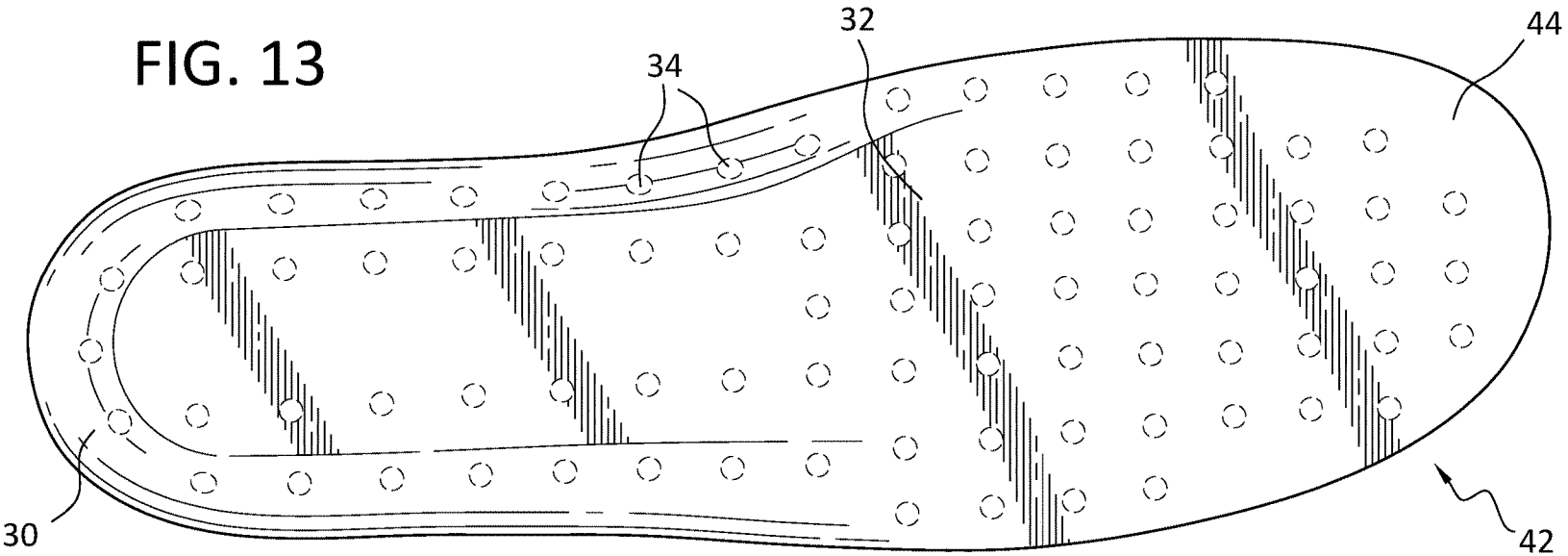
FIG. 13 is a top view of the insole shown in FIG. 11.
Figure 14:
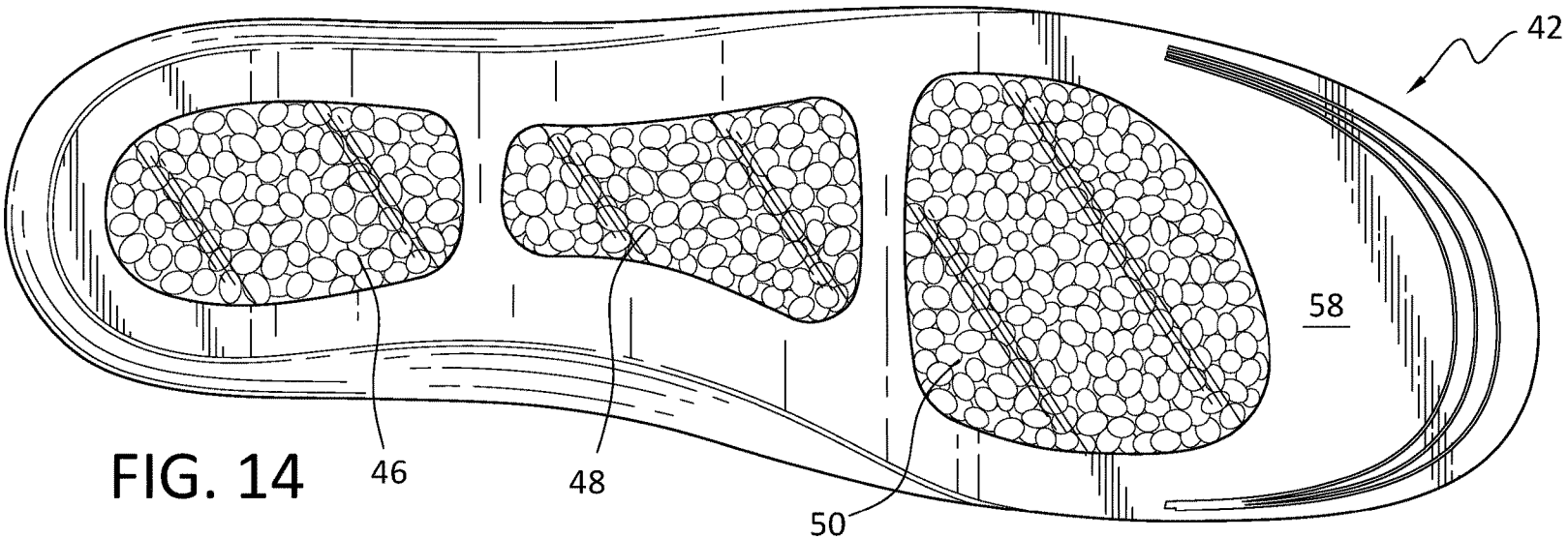
FIG. 14 is a bottom view of the insole shown in FIG. 11.
Figure 15:
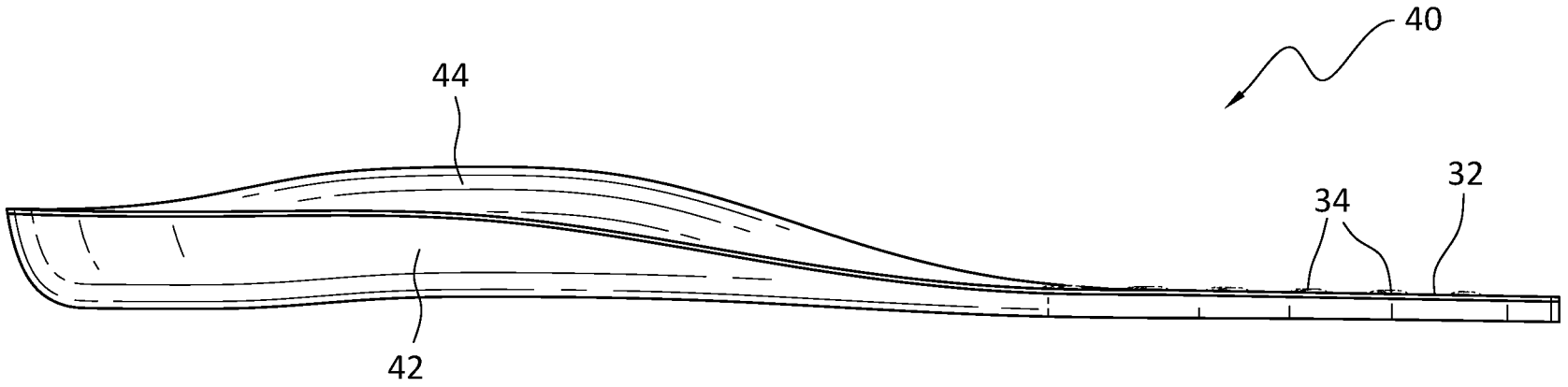
FIG. 15 is a left side view of the insole shown in FIG. 11.
Figure 16:
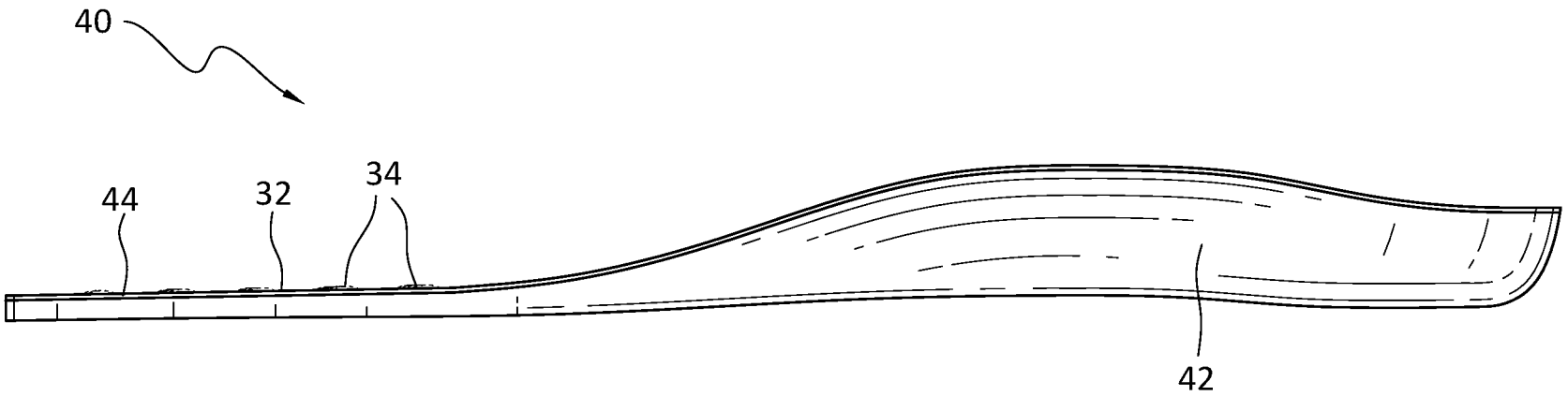
FIG. 16 is a right side view of the insole shown in FIG. 11.
Figure 18:
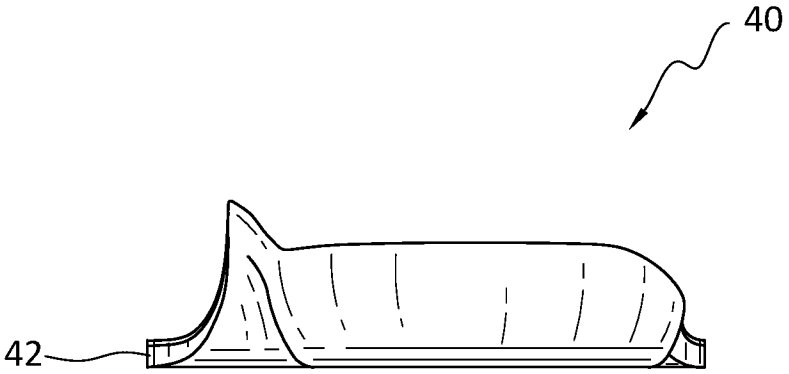
FIG. 18 is a rear view of the insole shown in FIG. 11.
Figure 17:
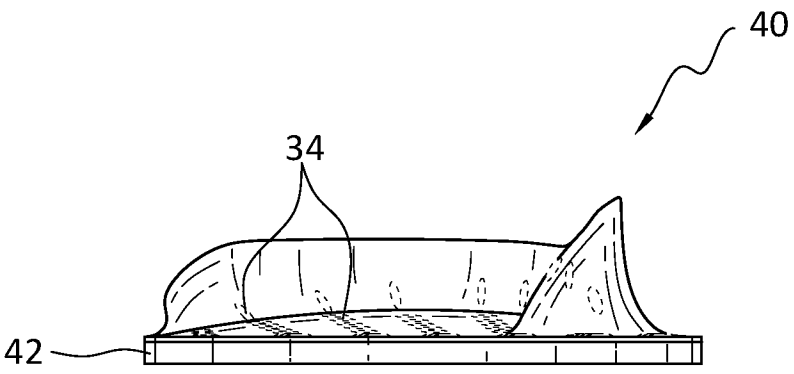
FIG. 17 is a front view of the insole shown in FIG. 11.

The air cushion 20 is particularly novel in that it has a sealing or enclosing structure 36 and a plurality of lightweight foam pieces 38 inside the sealing or enclosing structure 36 (see FIG. 10). In one embodiment, the sealing structure 36 is a membrane preferably made of plastic and attached to the base 12 around the periphery of the cavity 22 to enclose the foam pieces 38 therein. The foam pieces 38 are thus contained within an area defined by a side surface formed by part of the base 12 and the membrane. In another embodiment, a membrane entirely surrounds the foam pieces 38 to form a sealing and enclosing structure and this assembly is then inserted into the cavity 22 and secured therein. The membrane is thus alongside the side surface formed by part of the base 12 that defines the cavity 22.

In either case, there should be in the air cushion 20 sufficient foam pieces 38 to completely or almost completely fill the cavity 22 because these foam pieces 38 provide energy return as the air cushion 20 is compressed during use. This means that there is intentionally no air introduced into the air cushion 20 but rather it is filled to the extent possible with foam pieces 38. The foam pieces 38 are compressed within the air cushion 20, in view of their containment therein, when the wearer exerts downward pressure while standing or walking, and store energy. This stored energy is released when the wearer lifts their foot up providing an energy return of sorts.

The foam pieces 38 are freely movable within the sealing or enclosing structure 36 or membrane. This freedom of movement allows the foam pieces 38 to move when pressure is exerted, i.e., during usage by the wearer as they press their foot against the insole 10. Movement of the foam pieces 38 is however limited because the enclosing structure 36 should be full or almost completely full of such foam pieces. As such, the foam pieces 38 may be compressed against one another, with a view toward providing support to the wearer, and specifically, comfortable support.

Air cushion 20 is therefore extremely light in view of the use of the foam pieces 38, and soft. There may be hundreds of foam pieces 38, also referred to herein as popcorn pieces, with each potentially being compressed and releasing energy during steps taken by the wearer of the shoes in which the insole 10 is present.

FIGS. 11-20 show another embodiment of an insole, designated 40. Like insole 10, insole 40 has a base 42 (comparable to base 12), and a mesh 44 (comparable to mesh 18) and which is attached to the upper surface of the base 42. Differing from the single air cushion 20 in insole 10, insole 40 includes three air cushions 46, 48, 50 that are individual and independent of one another (see FIGS. 12, 14 and 19). Each air cushion 46, 48, 50 is constructed in a similar manner as air cushion 20, i.e., with foam pieces 38 serving like popcorn pieces, and with flat, substantially parallel upper and lower surfaces and a side surface extending at an angle to both the upper and lower surfaces and around the foam piece-filled interior of the air cushion (see FIG. 20). Common elements of insole 10 and insole 40 are designated by the same reference numbers.

Figure 19:
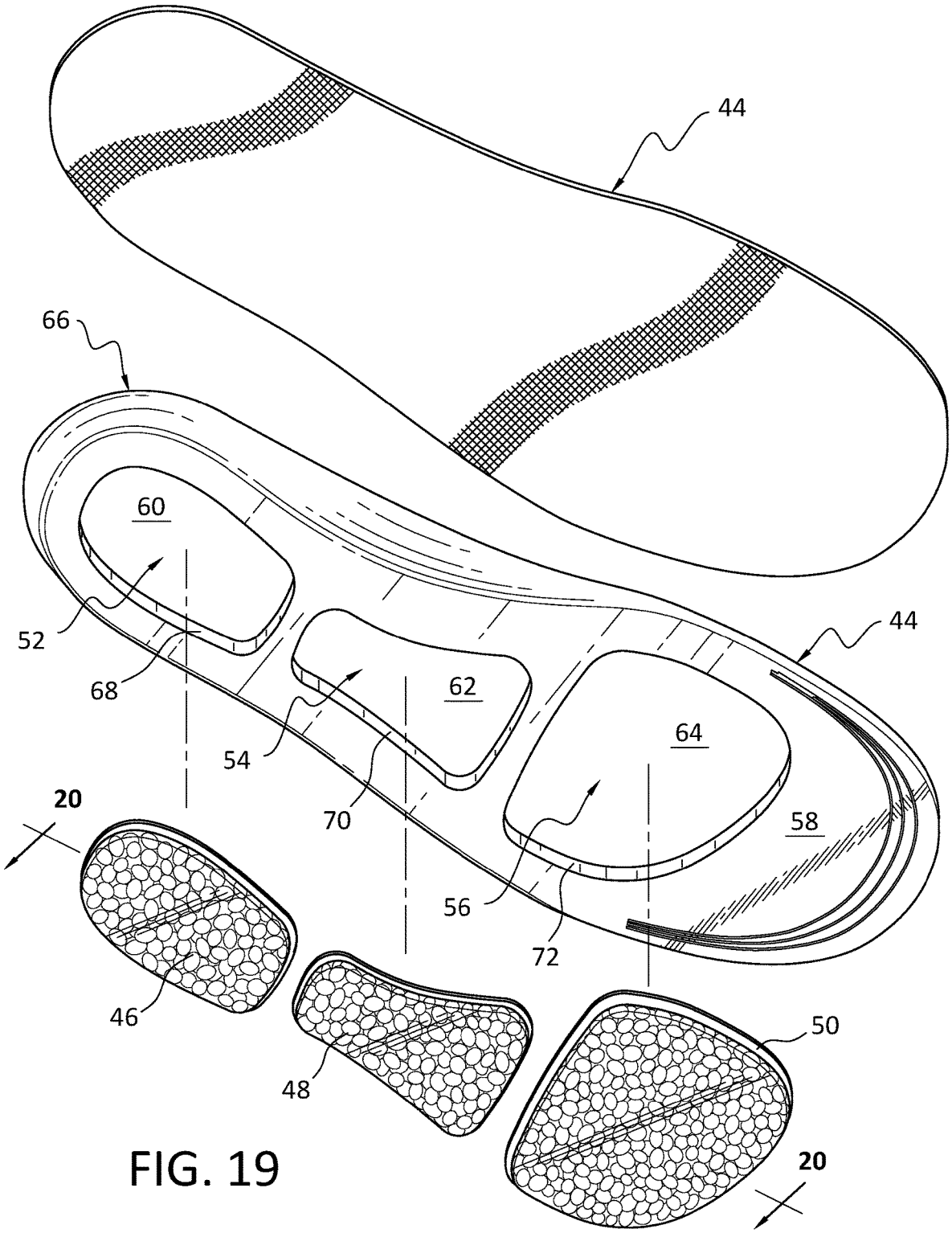
FIG. 19 is an exploded view of the insole shown in FIG. 11.
Figure 20:
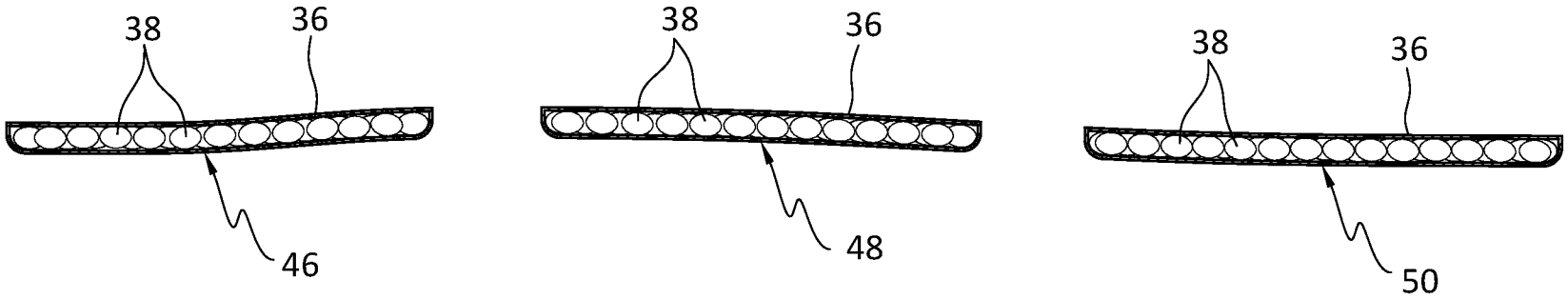
FIG. 20 is a cross-sectional view taken along the line 20-20 in FIG. 19.

To accommodate air cushions 46, 48, 50, the base 42 has three cavities 52, 54, 56 formed in the lower surface 58 of the base 42 so that a downward-facing surface 60, 62, 64 of the cavities 52, 54, 56, respectively, is inward of the lower surface 58 of the base 42, i.e., recessed inward in a direction toward an upper surface 66 of the base 42 (FIG. 19). The downward-facing surfaces 60, 62, 64 abut against the flat upper surfaces of the respective one of the air cushions 46, 48, 59 (FIG. 20). The cavities 52, 54, 56 are also defined by a side surface 68, 70, 72 that extends around the periphery of the respective cavity 52, 54, 56. The cavities 52, 54, 56 are within the base 42 in the sense that each has a surrounding side surface formed by part of the base 42 and does not extend to or through a side surface of the base 42. More specifically, as seen in FIG. 19, each side surface 68, 70, 72 is at an angle to and extends around the entire periphery of the respective one of the downward-facing surfaces 60, 62, 64 such that the air cushions 46, 48, 50 are bound along their side surfaces by the side surfaces 68, 70, 72 and on their upper surfaces by the downward-facing surfaces 60, 62, 64.

In the regions of the insole 40 that do not include any of the cavities 52, 54, 56, support and/or cushioning is provided by the combination of only the base 42 and the mesh 44 above the base 42 (the foot of the wearer being above the mesh 44). However, when any of the cavities 52, 54, 56 is present, then the support and/or cushioning is provided by the combination of the mesh 44 and the air cushion 46, 48, 50.

The lower surface of the base 42 will form the lowermost surface of the insole 40 at locations or areas at which the cavities 52, 54, 56 are not present, while the upper surface of the mesh 44 will form the uppermost surface of the insole 40. Where the cavities 52, 54, 56 are present, the air cushions 46, 48, 50 will provide the lowermost surface of the insole 40. This does not however preclude the presence of additional overlying or underlying layers.

The cavities 52, 54, 56 are shaped to enable the respective air cushion 46, 48, 50 therein to provide comfort and/or support to the person exerting pressure on the insole 40 via their foot when the insole 40 is used by being inserted into a shoe of the person or placed on a shoe support surface. To this end, the shape of the cavities 46, 48, 50 can vary and its shape designed with a view toward optimizing comfort and/or support for different shaped feet, as would be within the purview of those skilled in the art to which this invention pertains. The invention however provides one particularly beneficial arrangement and positioning of three cavities 52, 54, 56.

Specifically, the cavity 52 is in the heel area and has generally oblong shape. Cavity 54 is forward of cavity 52 and has a generally oblong shape with a flared area that tapers outward toward the front of the insole 40. Cavity 56 is situated in the area in which the sole or ball of the wearer's foot will be since this is an important location at which support should be provided. Thus, placement of the cavities 52, 56 at the heel and sole or ball of the foot ensures a cushioning effect at these critical areas.

The base 42 may be made of the same materials as base 12 and have the same or similar properties. The mesh 44 may be made of the same materials as mesh 18 and have the same or similar properties, e.g., with material or glue dots 34.

Assembly of insoles 10 and 40 may be provided in an exemplifying, non-limiting embodiment by providing the base 12, 42, mesh 18, 44 and air cushions 20, 46, 48, 50. For insole 10, the air cushion 20 is positioned in the cavity 22, and the mesh 18 and base 12 are then glued together and then heat-pressed to bond the components together. For insole 40, the air cushions 46, 48, 50 are positioned in the respective one of the cavities 52, 54, 56, and the mesh 44 and base 42 are then glued together and then heat-pressed to bond the components together. Attachment techniques other than gluing and heat-pressing may be used to bond the base 12 and mesh 18 together. Similarly, the air cushions 20, 46, 48, 50 may be glued into the cavities 22, 52, 54, 56 or attached in other ways, such through the use of heat and/or pressure.

The various embodiments of the insoles disclosed above are generally configured to serve as an air cushion with a flexible, and novel, popcorn cushion. Each may be suitable for people with flat feet and plantar fasciitis. The insoles have strong resilience, absorb shocks, provide additional cushioning and reduce stress on the foot to improve endurance in sport activities. Although cavities are shown in the base, it is also possible to provide apertures in the base, i.e., without a downward-facing surface of the base recessed inward form the lower surface of the base defining the cavity. In this case, the lower surface of the mesh would define the upper boundary of the cavity into which the air cushion is placed or the upper boundary defining the air cushion with a membrane that extends across the lower surface of the base.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although insoles 10, 40 and shown with a single cavity and three separate cavities respectively, it is contemplated by the inventor to provide different numbers of cavities in an insole in accordance with the invention. An insole with any number of such cavities, each with a respective air cushion with popcorn pieces of foam as disclosed above is part of the invention and considered to be encompassed by the claims.

The invention claimed is:

1. An insole, comprising:

a base having a shape for placement onto a sole of or in a shoe, said base having a lower surface and an upper surface opposite said lower surface, said base including first, second and third cavities each extending inward from said lower surface over only a part of said lower surface such that over a remaining part of said lower surface, said lower surface is a lowermost surface of the insole, said first, second and third cavities being three separate cavities, said first cavity being in a heel area of the insole and having an oblong shape, said second cavity being forward of said first cavity and having an oblong shape with a flared area that tapers outward toward a front of the insole, said third cavity being in an area configured to accommodate a sole or ball of the foot of the user closer to the front of the insole than said second cavity, each of said first, second and third cavities extending inward from said lower surface of said base and being defined in part by a downward-facing surface recessed inward of said lower surface of said base and a side surface at an angle to and extending around a periphery of the respective one of said downward-facing surfaces;

a mesh attached to said upper surface of said base and which forms an uppermost surface of the insole; and first, second and third air cushions each situated at least partly in a respective one of said first, second and third cavities, each of said first, second and third air cushions being peripherally surrounded by said side surface of the respective one of said first, second and third cavities and including a sealing structure and lightweight foam pieces held in the respective one of said first, second and third cavities by said sealing structure such that when in the respective one of said first, second and third cavities, said first, second and third air cushions are part of a lowermost surface of the insole.

2. The insole of claim 1, wherein said sealing structure comprises a membrane under said foam pieces and attached to said base around a periphery of the respective one of said first, second and third cavities such that the lowermost surface of the insole is provided by a combination of said membrane and said lower surface of said base.

3. The insole of claim 1, wherein each of said first, second and third air cushions comprises a membrane surrounding said foam pieces to thereby provide said sealing structure, said membrane being glued into the respective one of said first, second and third cavities and thus attached to said base.

4. The insole of claim 1, wherein said base is made of polyurethane or ethylene-vinyl acetate.

5. The insole of claim 1, wherein said base includes a heel part having a U-shape oriented in an upward direction.

6. The insole of claim 1, wherein said mesh has a lower surface attached to said upper surface of said base and an upper surface having material dots forming an anti-slip surface.

7. The insole of claim 1, wherein said mesh is made of breathable material providing air permeability.

8. The insole of claim 1, wherein said foam pieces are freely movable in or within said sealing structure.

9. The insole of claim 1, wherein said base further comprises cut marks at a front area to facilitate cutting of said base to a desired size.

10. The insole of claim 2, wherein said membrane is a plastic membrane.

11. The insole of claim 2, said side surfaces are formed by said base and said foam pieces are contained within an area defined by said membrane of a respective one of said first, second and third air cushions on a lower side and by said side surface.

12. The insole of claim 3, wherein said membrane is a plastic membrane.

13. The insole of claim 1, wherein each of said first, second and third air cushions comprises a membrane surrounding said foam pieces to thereby provide said sealing structure, said membrane being attached to surfaces of said base defining said first, second and third cavities.

14. The insole of claim 13, wherein said membrane is attached to the surfaces of said base defining said first, second and third cavities by glue.

15. The insole of claim 13, wherein said membrane is attached to the surfaces of said base defining said first, second and third cavities by heat or pressure.

16. The insole of claim 1, wherein said mesh has a peripheral shape that is the same as the peripheral shape of said base such that said mesh is attached to said upper surface of said base over its entire periphery.

17. The insole of claim 1, wherein said base has only said first, second and third cavities extending inward from said lower surface of said base and thus no other cavities extending inward from said lower surface of said base and no other cavities extending inward from said upper surface of said base.

18. The insole of claim 1, wherein the insole consists of at least one first region that each includes a portion of said mesh, a respective one of said first, second and third air cushions, and a portion of said base directly above a respective one of said first, second and third cavities and that extends to said upper surface of said base, and a second region that includes a remaining portion of said mesh and a remaining portion of said base extending from said lower surface of said base to said upper surface of said base, whereby in each one of said at least one first region of the insole, the insole provides support and/or cushioning to a foot of a user of the insole by a combination of said base, said mesh and said first, second and third air cushions in said one of said first, second and third cavities, and in said second region of the insole, the insole provides support and/or cushioning to the foot of the user of the insole only by a combination of said base and said mesh.

19. The insole of claim 1, wherein said first, second and third air cushions each include a flat upper surface that is against said downward-facing surface of the respective one of said first, second and third cavities.

20. The insole of claim 1, wherein said first, second and third air cushions each include upper and lower surfaces and a side surface extending between said upper and lower surfaces, said upper surface of said first, second and third air cushions being against said downward-facing surface of the respective one of said first, second and third cavities, and said side surface of said first, second and third air cushions being against said side surface of the respective one of said first, second and third cavities.

* * * * *